US005913806A

United States Patent [19]

Bock et al.

[11] Patent Number: 5,913,806

[45] Date of Patent: Jun. 22, 1999

[54] DEVICE TO CONVEY FIBERS TO THE COLLECTION SURFACE OF A SPINNING ROTOR

[75] Inventors: Erich Bock, Wettstetten; Kurt Lovas, Böhmfeld; Edmund Schuller; Eberhard Hofmann, both of Ingolstadt, all of Germany

[73] Assignee: Rieter Ingolstadt Spinnereimaschinenbau AG, Ingolstadt, Germany

[21] Appl. No.: 08/970,775

[22] Filed: Nov. 14, 1997

[51] Int. Cl.[6] ..... D01H 4/00

[52] U.S. Cl. ..... 57/406; 57/407

[58] Field of Search ..... 57/404, 406, 407, 57/408, 411, 412, 417

[56] References Cited

U.S. PATENT DOCUMENTS

| | | | |
|---|---|---|---|
| 3,367,099 | 2/1968 | Kubovy et al. . | |
| 3,651,632 | 3/1972 | Shepherd | 57/404 |
| 4,069,655 | 1/1978 | Stahlecker et al. | 57/407 |
| 4,112,659 | 9/1978 | Stahlecker et al. | 57/407 |
| 4,245,460 | 1/1981 | Staufert et al. | 57/407 |
| 4,653,266 | 3/1987 | Oexler et al. | 57/406 |
| 4,769,984 | 9/1988 | Raasch et al. . | |
| 5,109,663 | 5/1992 | Stahlecker et al. | 57/407 |
| 5,111,651 | 5/1992 | Pohn et al. | 57/411 |
| 5,117,622 | 6/1992 | Stahlecker | 57/411 |
| 5,595,058 | 1/1997 | Billner | 57/412 |
| 5,685,137 | 11/1997 | Raasch | 57/407 |

FOREIGN PATENT DOCUMENTS 2532637 2/1977 Germany .

OTHER PUBLICATIONS

German Patent Office Search Report, Feb. 3, 1997.

*Primary Examiner*—William Stryjewski
*Attorney, Agent, or Firm*—Dority & Manning

[57] ABSTRACT

The present invention relates to a device for the conveying of fibers from an opener roller (31) installed in a fixed opener roller housing (30) to the collection surface (43) of a spinning rotor (4) of an open-end spinning device (1). It is provided with a rotor lid mounted on a swivel pin which receives a fiber feeding channel (6). The fiber feeding channel (6) can be brought into contact with a first contact surface (62) surrounding its inlet opening (60) against a second contact surface (35) located on the opener roller housing. It extends until directly in front of the collection surface of the spinning rotor (4). A lid extension extends through an opening in the spinning rotor (4) into the spinning rotor. In the lid extension the fiber feeding channel (6) lets out into the spinning rotor (4). The contact surfaces are essentially tangential to the circumferential surface of the opener roller and parallel to the opening of the spinning rotor or are inclined towards the opening of the spinning rotor.

14 Claims, 5 Drawing Sheets

S1
42
40
5
γ
61
β
43
50
65
66
D2
D1
d1
d2
41
4
S2
10
30
6
35
62
34
60
f
32

DEVICE TO CONVEY FIBERS TO THE COLLECTION SURFACE OF A SPINNING ROTOR

BACKGROUND OF THE INVENTION

In a known device the rotor lid is attached to a swiveling cover which covers the spinning station so that the rotor lid follows the movement of the cover (DE 25 32 637 A1). The cover is however supported below the opener device which precedes the spinning rotor so that the rotor lid carries out a sliding movement at the interface between the opener device housing and the fiber feeding channel, so that a seal provided at this location is subjected to heavy wear.

OBJECTS AND SUMMARY OF THE INVENTION

It is a principal object of the present invention to create a device, and in particular a rotor cover in this instance, by means of which the disadvantages of the technology known in the state of the art are avoided. In particular, it is the purpose of the present invention to find a solution by which lateral relative movements at the interface between opener roller housing and fiber feeding channel are mostly avoided.

In accordance with the objects of the invention, the rotor lid is moved in the direction of the operator side together with the outlet opening of the fiber feeding channel for the freeing of the rotor housing which is open towards the operator side of the open-end spinning device, while at the same time the outlet opening located on the side of the opener roller housing away from the operator side which is followed by the fiber feeding channel is freed in order to make the movement of the rotor lid possible. By suitably placing the swivel axle of the rotor lid, it is possible to determine exactly the angle by which the rotor lid is moved relative to the opener roller housing or relative to the rotor housing. Furthermore, this design is the basis for a simple design of the device according to the invention when the fiber feeding channel is made in one piece.

The plane along which the rotor lid extends is determined by the spinning rotor located in the rotor housing. Therefore, it is possible to be merely flexible with respect to the placement and orientation of the interface between the opener roller housing and the rotor lid, or the fiber feeding channel supported by same. For this reason, the swivel axle according to the present invention is advantageously placed at a greater distance from the center of the rotor lid than from the first contact surface of the fiber feeding channel, since in this manner the contact between the rotor lid and the rotor housing can be adapted with particular ease to the difficult sealing conditions between rotor housing and rotor lid.

The rotor lid is a part which must be replaced for adaptation to different conditions, or where parts must be replaced to adapt to other conditions, e.g. different yarn fullness and roughness. According to the invention, a rapid expansion and subsequent integration of the rotor lid in a design wherein the rotor lid is provided with a fork-like drag bearing by means of which it can be mounted on the swivel pin is easily achieved. Here such integration and removal of the rotor lid can be further facilitated by designing the device such that the swivel pin has a cylindrical longitudinal section on which a rotor lid is located in its work position, and a flattened longitudinal section in which the rotor lid can be removed from the swivel pin or can be mounted on the swivel pin, and wherein the flattened longitudinal section extends along the center line of the fork-like bearing when the rotor cover is open.

By designing the device according to the invention wherein a stop secures the rotor cover axially in its closed position and releases it in its open position, it is possible in a simple manner to secure the rotor lid axially in its closed position, while it is freed in its open position for axial displacement, so that the rotor lid can be removed more easily from its swivel axle.

Especially favorable movement conditions for the rotor lid are obtained with a placement of its swiveling axle in a plane extending perpendicularly to the axis of the spinning rotor.

As mentioned previously, the rotor lid is replaced for adaptation to different rotor diameters by corresponding rotor lids with different dimensions. In that case, the fiber feeding channel must also let out at different points into the rotor housing as a function of the rotor diameter selected, so that its outlet opening may be located optimally across from the inner wall of the spinning rotor, and for this reason it is necessary to place the outlet opening at different points accordingly in the rotor lid. By making the device according to the invention with a fiber feeding channel extending in a straight line between the two contact surfaces, the rotor lid can be replaced by a rotor lid of different size to adapt to another rotor diameter and in that the fiber feeding channel is placed at different angles to the plane along which the rotor lid extends, depending on the diameter of the spinning rotor, it is possible to make the fiber feeding channel nevertheless in a straight line in all applications.

By placing the swiveling axles of the rotor lid in accordance with the invention, a seal can be omitted in principle at the interface, since the movement of the rotor lid can be carried out with such precision that a seal can be achieved at the interface even without having to use an additional sealing means. In order to avoid with certainty, redundancies in the closing and operating positions of the rotor lid and in order to compensate for setting variations which may occur due to imprecise tolerances, it is however advantageous to provide a seal on one of two interacting surfaces on the fiber feeding channel and the opener roller housing.

Secure mutual contact between the interacting contact surfaces of opener roller housing and fiber feeding channel is achieved by providing a flange-like widening on the portion of the fiber feeding channel which contains the inlet opening, whereby it is advantageous to locate the seal in the flange-like widening.

The object of the invention is advantageously made such that, as seen in the direction of rotation of the opener roller, the first wall of the fiber feeding channel is recessed relative to the inner circumferential wall of the opener roller housing located in front of the outlet openings, because in this manner favorable movement conditions as well as good fiber conveying conditions within the opener roller housing as well as into and within the fiber feeding channel are achieved.

The invention is easy to produce and is optimized by the direct support of the rotor lid in the described manner. The movement of same, in particular in the critical movement phases, in the vicinity of the two interfaces during pressing against the counter-surfaces to be sealed or during lifting from same is optimized. In particular, lateral movements which could lead to rapid wear of the interacting surfaces and seals are thereby reduced to an insignificant level, so that the life of these parts and of the parts interacting with them is extended. The compact and simple design of the device according to the invention ensures simple and inexpensive manufacture.

Examples of embodiments are explained in further detail below through drawings.

DETAILED DESCRIPTION OF THE PREFERRED EMBODIMENTS

Figure 1:
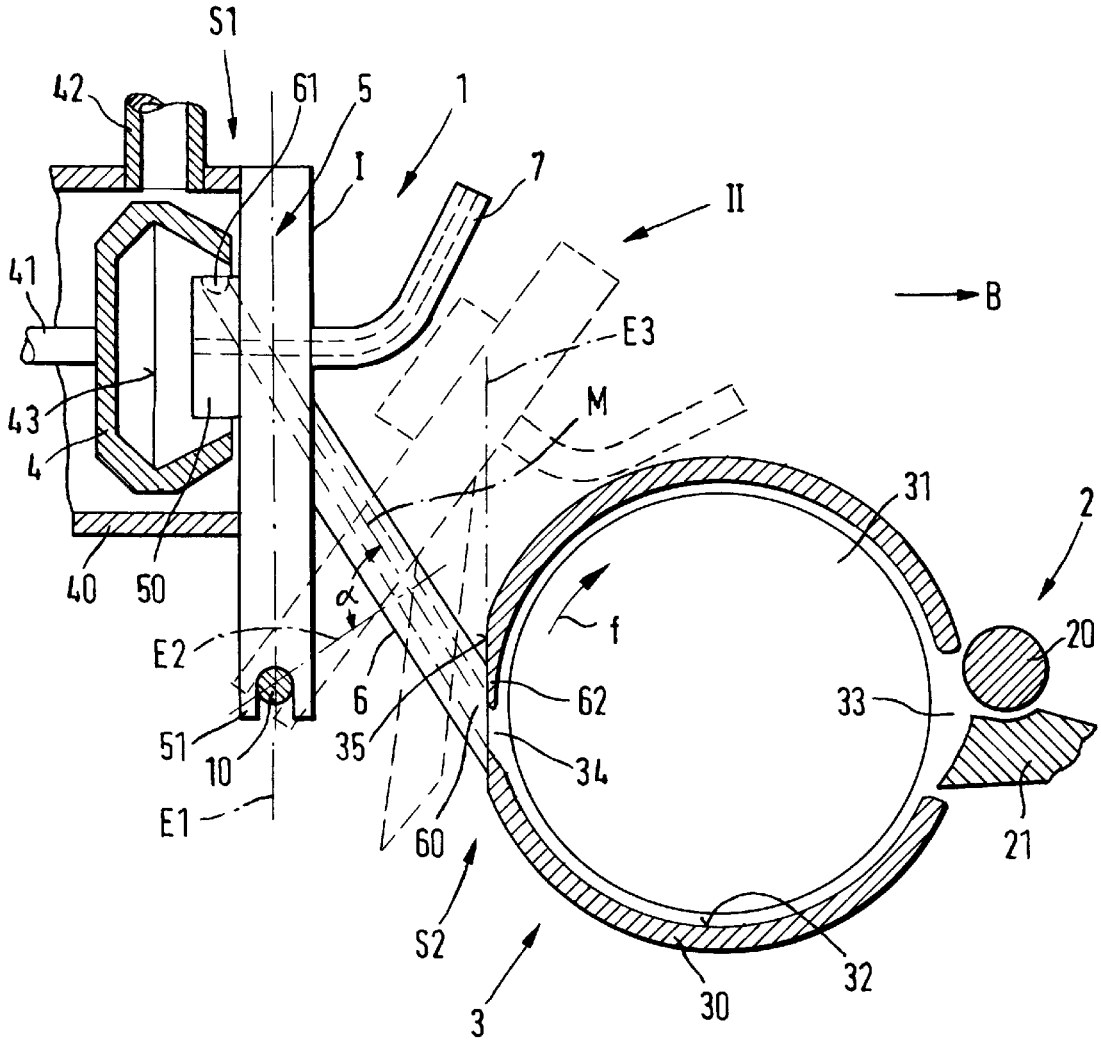
FIG. 1 shows an open-end spinning device in a cross-section, with a rotor lid made and supported according to the invention and indicated by a full line in its closed position and by a broken line in its open position.

Reference will now be made in detail to one or more presently preferred embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a further embodiment. It is intended that the present invention cover such modifications and variations.

FIG. 1 shows the essential parts of an open-end spinning device 1 which are necessary to understand the present invention. The other parts of an open-end spinning device 1 which are not shown are of conventional construction and function.

The open-end spinning device 1 shown is provided in the usual manner with a feed device 2, a fiber sliver opener device 3, a spinning rotor 4 mounted in a rotor housing 40 as well as a rotor lid 5 with a fiber feeding channel 6 and a yarn draw-off pipe 7 as connecting element between the fiber sliver opener device 3 and the rotor housing 40.

The feed device 2 can be made in the usual manner; according to the embodiment of the example shown it is provided with a feed roller 20 extending over several adjoining spinning stations which all have an open-end spinning device 1 of identical design and against which a feed trough 21 is pressed by elastic means not shown here.

The fiber sliver opener device 3 is furthermore provided with a opener roller housing 30 in the example of an embodiment shown, in which a opener roller 31 is rotatably installed and which is equipped in the usual manner with clothing for the opening of a fiber sliver which is not shown into individual fibers. In addition to possibly being provided other openings which are of no interest here, the opener roller housing 30 is provided with a fiber sliver feed point in the form of a feed opening 33 in the area of the feed device 2 in its circumferential wall 32 for the feeding of the fiber sliver to be opened. Essentially diametrically across from this feed opening 33, an outlet opening 34 is located in the circumferential wall 32 through which the fibers (not shown) leave the opener roller housing 30 in order to enter the fiber feeding channel 6

The spinning rotor 4 is mounted by means of a shaft 41 in the usual manner and which is therefore not shown so as to be rotatable. The rotor housing 40 which receives it is connected via a suction air line 42 for the production of a negative spinning pressure to a negative pressure source which is not shown. The rotor housing 40 is sealed in a known manner in the area of the shaft 41 of the rotor housing 40. To maintain the negative spinning pressure, the open side of the rotor housing 40 (interface $S_1$) is covered by means of the rotor lid 5 which can be swiveled from a work and closing position I, shown by a full line, into a waiting position II, in which the interior of the spinning rotor 4 is accessible.

The rotor lid 5 receives the fiber feeding channel 6 which is provided with a inlet opening 60 which is aligned with the outlet opening 34 of the opener roller housing 30 when the rotor lid 5 is in its work and closed position I. The inlet opening 60 of the fiber feeding channel 6 is surrounded by a first contact surface 62 which presses in the work and closed position I of the rotor lid 5 sealingly against a second contact surface 35 surrounding the outlet opening 34 of the opener roller housing 30 The two contact surfaces 35 and 62 together constitute an interface $S_2$. The fiber feeding channel 6 extends in a straight line from its inlet opening 60 to its outlet opening 61 which is located in the circumferential wall of a lid extension 50 of the rotor lid 5 extending into the interior of the spinning rotor 4.

Before discussing further details of the rotor lid 5 and of its support, the function of the device, the structure of which has been described, shall be explained:

The feed device 2 serves to present the fiber sliver to be opened to the opener roller 31 which rotates in the opener roller housing 30 and which detaches individual fibers from the forward end of the fiber sliver and conveys them in a clockwise direction to the outlet opening, whereby the opener roller 31 is assisted by the negative spinning pressure prevailing in the rotor housing 40 and which takes effect from the rotor housing 40 through the fiber feeding channel 6 and into the opener roller housing 30. The fibers enter the fiber feeding channel 6 due to this negative spinning pressure and leave it again through its outlet opening 61 in order to glide along the inner wall of the spinning rotor 4 and thus to reach its collection surface (collection groove 43). Here they are incorporated into the end of a yarn which is not shown and which is drawn off by means of the usual devices through the yarn draw-off pipe 7 and is conveyed to a winding device to form a bobbin (not shown).

The rotor lid 5 extends essentially along a plane $E_1$ in which a drag bearing 51 is also located, by means of which the rotor lid 5 is mounted pivotably on a swivel pin 10. This swivel pin 10 is as distant as possible from the actual rotor lid 5 (see distance a in FIG. 2), i.e. from its area covering the rotor housing 40 (s1), so that the swiveling motion of the rotor lid 5 near the open side of the rotor housing 40 may be as perpendicular as possible to the sealing surface (interface$_{S1}$) between the rotor housing 40 and the lid extension 50. On the other hand however, the selection of the placement of the swivel pin 10 relative to the area of the rotor lid 5 covering the rotor housing 40 (interface$_{S1}$), as well as to the interface S2 between the opener roller housing 30 and the fiber feeding channel 6, should be such that here too the movement of the fiber feeding channel 6 is as perpendicular as possible to a contact surface 35 provided on the outer wall of the opener roller housing 30. It is provided for this purpose that the swivel pin 10 be located at a point between the two interfaces $S_1$ and $S_2$ such that the movement phases in proximity of the two interfaces $S_1$ and $S_2$ be as perpendicular as possible to the two interfaces $S_1$ and $S_2$. This is achieved in that the swivel pin 10 is located in a plane $E_2$ which intersects the center line M of the fiber feeding channel 6 perpendicularly, i.e. at a right angle á. The rotor lid 5 together with the fiber feeding channel 6 which it supports thus becomes a two-arm lever the two ends of which are the interfaces $S_1$ or $S_2$.

Figure 2:
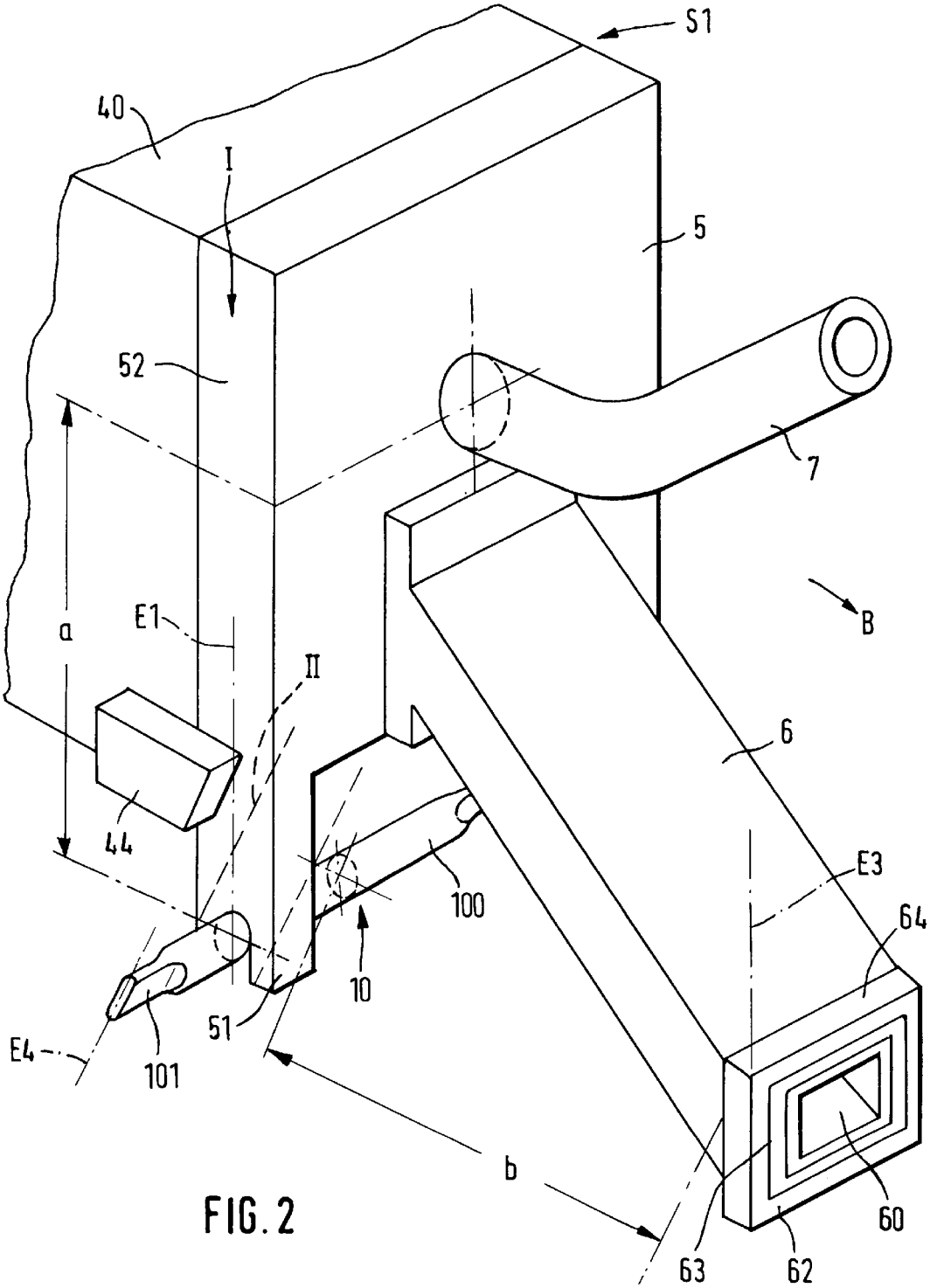
FIG. 2 shows a view of a rotor lid according to the invention in perspective.

According to FIG. 2, which shall be described in detail further on, the distance a between the swivel pin 10 and the center of the rotor lid 5 where the yarn draw-off pipe 7 is located is greater than the distance b between the swivel pin 10 and the inlet opening 60 of the fiber feeding channel 6. Even if not specifically referenced, this length relation can nevertheless be recognized clearly in FIG. 1. Since the interface$_{S1}$ is greater than the interface S2, it is more difficult to seal them properly, and for this reason adjustment is simpler when the distance is greater than distance b.

The inclination of the interfaces S1 and S2 relative to the connecting lines between the swivel pin 10 on the one hand and the interface S1 or S2 on the other hand has also an essential influence in this connection. Because of the greater size of the interface S1 by comparison with interface S2, the interface$_{S1}$ is oriented essentially along the connecting line between the swivel pin 10 and the interface S1 in order to achieve optimal movement conditions in proximity of interface S1 in spite of its size.

As FIG. 1 shows, the interface S2 is located on the side of the opener roller housing 30 away from the fiber sliver-feed point (feed device 2). This is made possible because in this embodiment of the opener roller housing 30 and the rotor lid 5, the latter is swiveled away from the operator side B and not towards the operator side B as in the known state of the art. Due to this fact, it is not necessary to make the wall of the opener roller housing 30 so thick in the vicinity of the interface S2 that the fiber feeding channel 6 can be swiveled beyond the opener roller housing 30 to the operator side B. As shown in FIG. 1, the wall thickness of the opener roller housing 30 in the vicinity of the interface S2 is rather negligibly thin, so that the interface S2 has no effect on the fiber flow because it is located in immediate proximity of the point where the fibers are detached from the clothing of the opener roller 31.

The placement of the interface S2 and of the contact surface 35 on the side of the opener roller housing 30 away form the operator side B, essentially across from the feed opening 33 which constitutes the fiber sliver feed point, has furthermore the advantage that this interface $S_2$ is not in an area in which the operator is busy during maintenance of the open-end spinning device 1, but in an area of the open-end spinning device 1 away from it. To make this protective arrangement of this interface S2 possible on the one hand, and in order not to require making the fiber feeding channel 6 too long on the other hand, which would have a disadvantageous effect on the fiber conveying as well as on the handling of the rotor lid 5, the interface S2 in the embodiment shown in FIG. 1 is located in one and the same plane $E_3$ with the two interacting contact surfaces 35 and 62, said plane $E_3$ being essentially parallel with the plane $E_1$ along which the rotor lid 5 extends.

The rotor lid 5 in the embodiment shown in FIG. 1 has a fork-shaped recess constituting a drag bearing 51 by means of which it is mounted on the swivel pin 10 by being transfixed on it. Such a design of the drag bearing 51 makes it possible, without using any tools, to remove the rotor lid 5 very quickly if this should be necessary on occasion for maintenance purposes. In this case, this removal can be effected to improve the accessibility of the interior of the spinning rotor 4 or to replace the rotor lid 5 by a rotor lid 5 of different size in adaptation to a spinning rotor 4 with a different size, or of different form, as shall be explained in further detail later through FIG. 3. Furthermore, such a removal of the rotor lid 5 may be necessary when the yarn draw-off nozzle, which is not shown and is installed in the lid extension 50, is to be replaced by a yarn draw-off nozzle of different design in order to produce a yearn having different characteristics in this manner, e.g. with a different fullness or twist.

For accessibility to the interior of the spinning rotor 4, no removal of the rotor lid 5 is normally required, because a suitable placement of the swivel pin 10 and relative placement of rotor housing 40 and opener roller housing 30 with the correspondingly designed fiber feeding channel 6 can ensure that the rotor lid 5 can be swiveled so far that it uncovers the interior of the spinning rotor 4 for maintenance.

Since the rotor lid 5 is a core part of the described device, a rotor lid 5 designed in the manner described is shown in perspective in FIG. 2. The drag bearing 51 of the rotor lid 5 in the form of a fork is clearly recognizable, and the rotor lid 5 is mounted with its help on the swivel pin 10 by being merely transfixed on it so as to be properly held in the open-end spinning device 1. As indicated by a full line, the rotor lid 5 is in its work and closed position I and can be brought into maintenance position II by swiveling it around the swivel pin 10. The swivel pin 10 is non-rotatably installed in the open-end spinning device 1 and in addition to the longitudinal section 100 which supports the rotor lid 5 in its work and closed position I, is provided with another longitudinal section 101 which has a flattened cross section by contrast with the cylindrical bearing area (longitudinal section 100). Here, the flattening in the longitudinal section 101 is such that the larger diameter (see plane $E_4$) extends along or is parallel to the plane $E_1$ in which the rotor lid 5 essentially assumes its maintenance position II and alongside which the fork-shaped recess of its drag bearing 51 extends also when the rotor lid 5 is in this position.

As long as the rotor lid 5 is on the cylindrical longitudinal section 100 of the swivel pin 10 the rotor lid 5 tightly encloses the swivel pin 10 with its drag bearing 51. Under these circumstances greater resistance must be overcome to pull the rotor lid 5 from the swivel pin 10, in particular when the rotor lid 5 is slightly tilted or angled laterally at the same time. This same condition applies in an analogous manner for the transfixing of a new rotor lid 5. The remedy in this case is the design shown in FIG. 2, with the flattened longitudinal section 101 of the two drag bearings of the rotor lid 5. If the rotor lid 5 is to be removed from its swivel pin 10, the rotor lid 5 is first swiveled from its work and closed position I into its maintenance position II. The rotor lid 5 is then displaced in the longitudinal direction of the swivel pin swivel pin 10 and this is done without difficulty. The drag bearing 51 thus comes in proximity of the flattened longitudinal section 100 the longitudinal extension of which now coincides with the longitudinal extension of the fork-shaped recess (drag bearing 51). This relative clearance exists between the swivel pin 10 and the drag bearing 51 making it possible to easily install or remove a rotor lid 5 since it encounters little resistance.

By designing the two interfaces $S_1$ and $S_2$ as required, the rotor lid 5 is fixed in its precise position relative to the adjoining components with which it interacts as long as it is in its work and closed position I. Nevertheless, it may be advantageous in order to avoid unnecessarily stressing the seals which may be provided at these two interfaces $S_1$ and $S_2$, which shall be mentioned further below, if the rotor lid 5 is secured axially independently of the interfaces $S_1$ and $S_2$ as long as it is in its work and closed position I. For this purpose, a stop 44 is provided on the side of the rotor housing 40 according to FIG. 2, against which the rotor lid 5 presses with its lateral edge 52 when it is in its work and closed position I. When the rotor lid 5 is swiveled from its work and closed position I into a maintenance position II, it leaves the area of the stop 44. It is thus released from the stop 44 and can be displaced axially for removal. Inversely, the rotor lid 5, after being installed on the flattened longitudinal section 101, is brought by axial displacement to the cylindrical longitudinal section 100 where it is then swiveled into its work and closed position I.

If desired, the stop can also be placed at some other suitable location and may possibly be movable to be brought into or out of the work position. For example, the rotor lid 5 may be provided with a locking device (not shown) which secures the rotor lid 5 in its work and closed position I and furthermore secures the rotor lid 5 relative to the swivel pin 10.

The stop 44 may be provided with a ramp-like run-up slope (not shown) for the rotor lid 5 by means of which a rotor lid 5 which is not perfectly aligned axially can be brought into its precise axial work position when the rotor lid 5 is moved from its maintenance position II into its work and closed position I.

It goes without saying that the axial displacement becomes necessary only when the rotor lid 5 is being removed or reinstalled.

It was not mentioned in particular so far that seals are provided on the interfaces $S_1$ and $S_2$ or may be provided thereon. In principle it is not absolutely necessary with today's manufacturing and adjusting possibilities to use seals on the two interfaces $S_1$ and $S_2$, even if this is recommended in general. FIG. 2 shows through the example of the interface S2 that the fiber feeding channel 6 is provided with a first contact surface 62 in which a seal 63 is supported on its end to be presented to the contact surface 35. It is of course also possible as an alternative to provide a seal (not shown) on the contact surface 35 of the opener roller housing 30 instead of in the first contact surface 62 of the fiber feeding channel 6.

So as to be able to give the fiber feeding channel 6 thin walls while nevertheless obtaining a relatively large first contact surface 62 which is able to interact with the contact surface 35 of the opener roller housing 30 (independently of the fact whether one of the two contact surfaces is or is not provided with a seal 63), the end of the fiber feeding channel 6 is provided with a flange-shaped widening 64 which is either put in contact with the actual fiber feeding channel 6 or constitutes an integral component of same. According to the embodiment of the example, the seal 63 is located in this widening 64.

The present invention is not limited to the embodiments shown and described, but can be varied in many ways, e.g. by replacing individual characteristics by equivalents or through other combinations of characteristics. Thus for instance, an open-end spinning device 1 can be designed so that spinning rotors 4 of different form and/or size can be used. In such a case, it is necessary when replacing the spinning rotor 4 by a spinning rotor 4 of different size, to adapt also the rotor lid 5 to the knew circumstances by replacing it with another one. This means that a rotor cover 5 with different dimensions must also be used to match the spinning rotor 4 now used.

Figure 3:
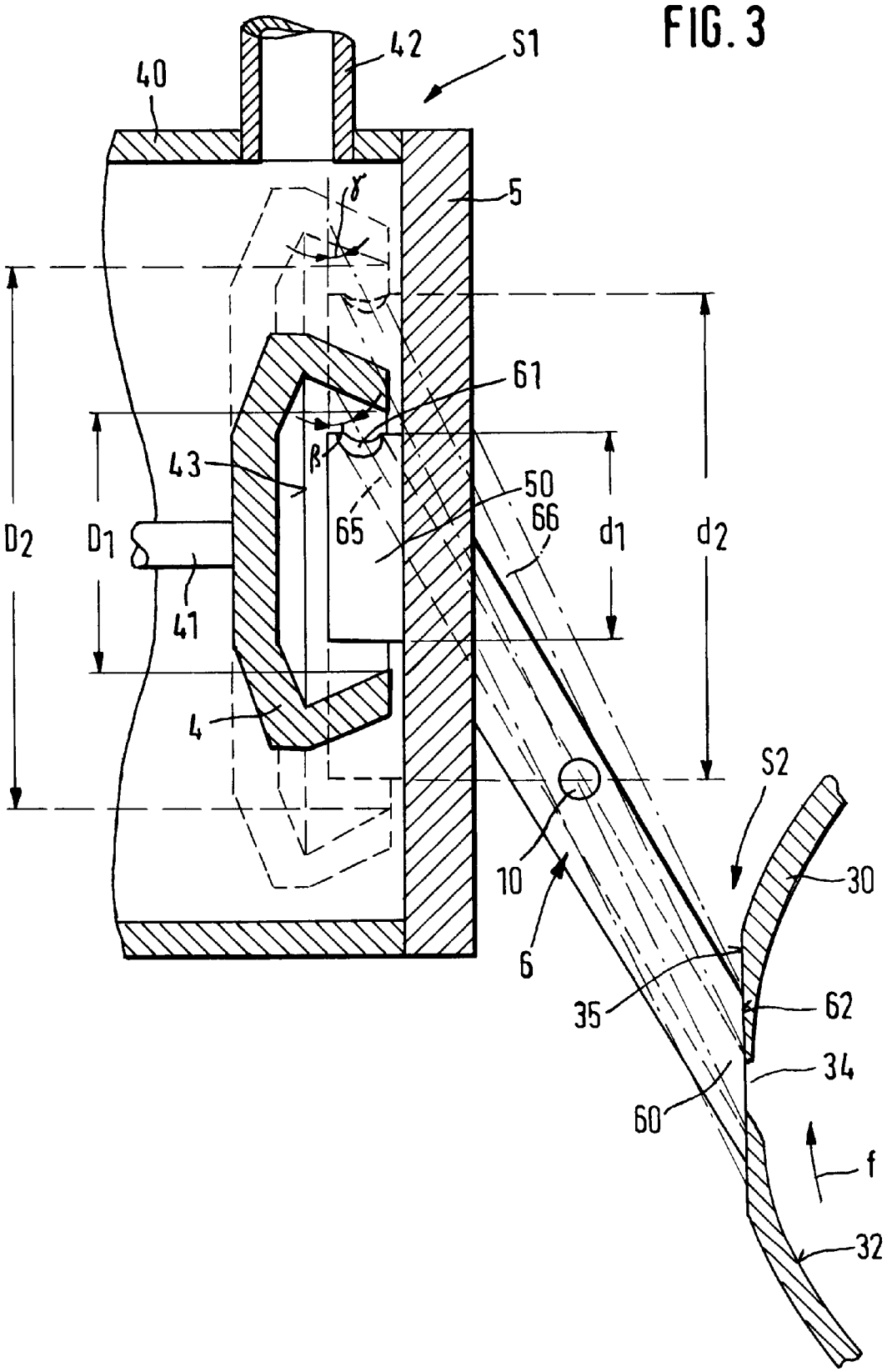
FIG. 3 shows an open-end spinning device in cross-section with a fiber feeding channel which is shown by a full line as it is adapted to a spinning rotor with a large diameter and by a broken line as it is adapted to a spinning rotor with a small diameter.

In FIG. 3, a full line indicates a spinning rotor 4 with a, whereby the lid extension 50 extending into the open side of the spinning rotor 4 also has a correspondingly smaller diameter $d_1$. If on the other hand the spinning rotor 4 has a D2., then the diameter $d_2$ of the lid extension 50 must also be selected so as to be correspondingly larger. When changing the diameter $d_{.1}$ or—$d_2$, the placement of the outlet opening 61 of the fiber feeding channel 6 also changes correspondingly, while the placement of the inlet opening 60 remains unchanged. Nevertheless, and independently of the selected form and the selected diameter $D_1$ or $D_2$ of the spinning rotor 4 used, the fiber feeding channel 6 can always have a straight form as is shown in the example of the two fiber deeding channels 65 (shown by broken lines with outer contour in full line) and 66 (dot-dash representation). As a comparison between these two fiber feeding channels 65 and 66 shows, only the angle â or ã changes relative to the collection groove 43 of the spinning rotor 4 or to the plane going through the front of the lid extension 50—and correspondingly, also the angle with which the fiber feeding channel 65 or 66 connects with its inlet opening 60 to the outlet opening 34 of the opener roller housing 30. This has however no effect on the conveying of the fibers, so that the fiber orientation and stretching is not in any way affected by this.

In the example of the embodiment in FIGS. 1 and 2, the swivel pin 10 is located in a plane E2 which intersects the center line M of the fiber feeding channel 6 perpendicularly, and this on the side towards the spinning rotor 4, relative to the fiber feeding channel 6. This is however not an absolute pre-condition for the design of the described device. If space allows, the swivel pin 10 can also be located in a plane intersecting the fiber feeding channel 6 (or 65 or 66) in longitudinal direction, as shown in FIG. 3, or even on the side away from the rotor lid 5 of the fiber feeding channel 6, 65 or 66. Here, a closed bearing can be provided also, as was shown and explained before through FIGS. 1 and 2.

If the necessity of removing or exchanging the rotor lid 5 is not expected to occur frequently, or under normal circumstances even not at all, a conventional bearing system with swivel pin 10 and bearing bushing (not shown) can be provided.

For the sake of clarity, FIG. 3 does not show the yarn draw-off pipe 7, but it goes without saying that it is present in the usual manner.

Figure 4:
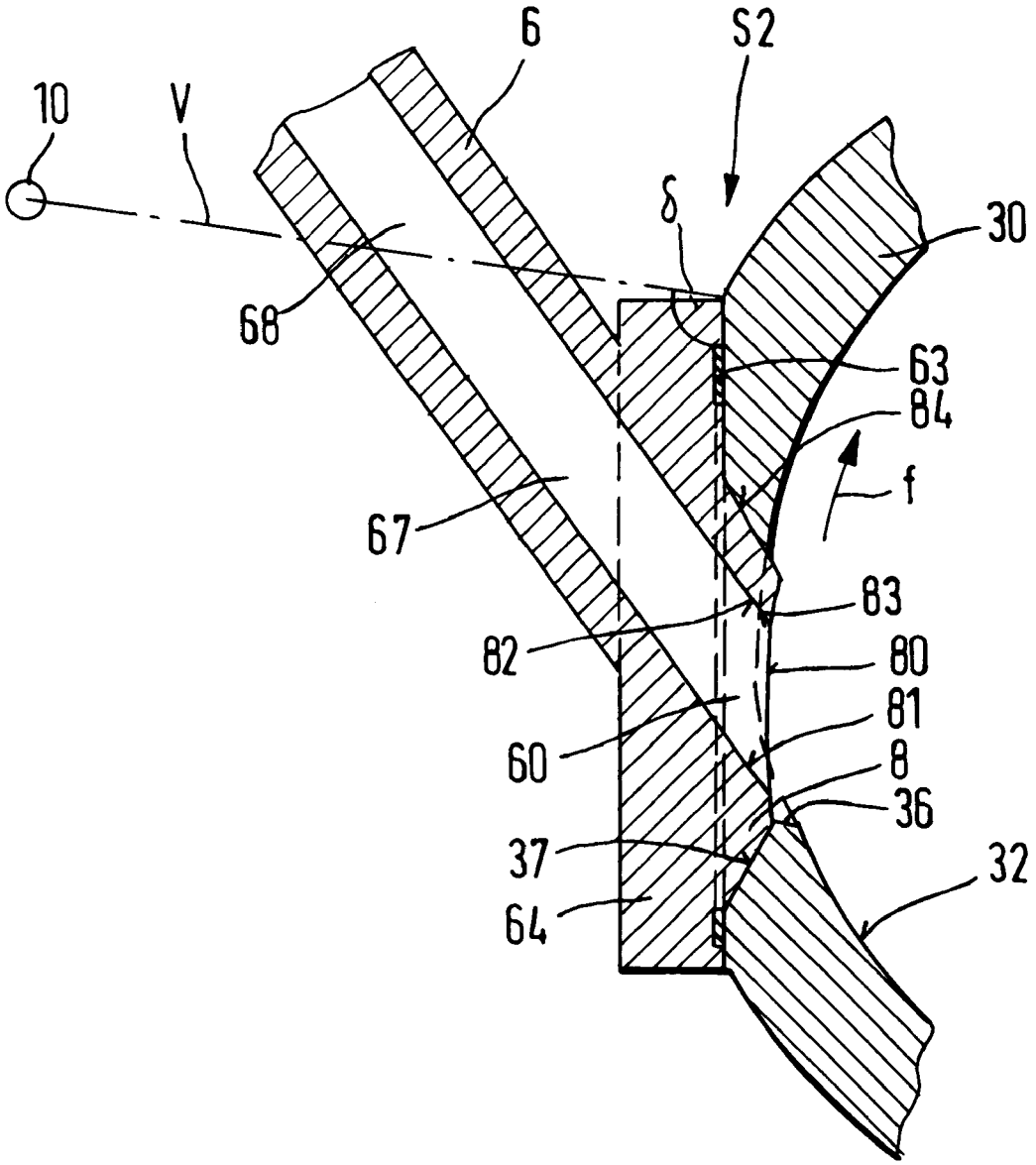
FIG. 4 shows the interface between fiber feeding channel and opener roller housing in the preferred design, in a cross section.

Another embodiment of the interface S2 is shown in FIG. 4. In this case, the fiber feeding channel 6 has a projection 8 on its side towards the opener roller housing 30, this projection extending into a matching recess 36 in the opener roller housing 30. The face 80 of this projection 8 is here adapted in form to the contour of the inner circumferential wall 32 of the opener roller housing 30. In this manner there is no interruption whatsoever in the movement of fibers between the outlet opening 34 of the opener roller housing 30 and the inlet opening 60 of the fiber feeding channel 6, since the latter is practically at the same time outlet opening 34 and inlet opening 60. Even if FIG. 4 shows a flange-like widening 64 in the area of the inlet opening of the fiber feeding channel 6, it can be omitted if the recess 36 is configured accordingly.

In order to be certain that the fibers do not catch on the projection 8 of the fiber feeding channel 6, provisions are made in the embodiment of FIG. 4 for the first wall 81 of the fiber feeding channel 6—and therefore also the projection 8 in all on this side—as seen in the direction of rotation (arrow f) is slightly recessed relative to the one in front of the recess 36 (=outlet opening 34) in the circumferential wall 32 of the opener roller housing 30, so that the inner circumferential wall 32 of the opener roller housing 30 slightly extends beyond the projection 8. Inversely, the second wall 82 and thereby the projection 8 on this side as seen in the direction of rotation (arrow f) of the 31 extends beyond the circumferential wall 32 of the opener roller housing 30, i.e. the projection 8, on its side with the wall 82, extends further into the interior of the opener roller housing 30 and thereby also closer to the opener roller 31, so that here too no impact point, where fibers may catch, is formed. The remaining distance between projection 8 and the clothing of the opener roller 31 is of course sufficiently large so that no danger of collision exists. In addition, and according to FIG. 4, the surface 83 through which the second wall 82 of the fiber feeding channel 6 merges into its face 80 is convex, so that thanks to the absence of a sharp edge no danger exists here for fibers to catch.

A connecting line V between the swivel pin 10 and any point of the first contact surface 62 or of the inner walls 37 forms an angle * of at least 90°. This has the effect that the contact surface 62 and the inner walls 37 do not collide with the corresponding surfaces of the opener roller housing 30 when the rotor lid 5 is swiveled away from the opener roller housing 30. This also applies to the outer wall 84 and all corresponding interacting surfaces.

The fiber feeding channel 6, 65 or 66 shown in FIGS. 1 to 4 may have the usual inner contour, independently of the shown outer contour. Thus it is customary to provide a longitudinal section 67 (see FIG. 4) in the area of the fiber feeding channel 6, 65 or 66 with strong conicity towards the opener roller housing 30, which is followed by a longitudinal section 68 with lesser conicity, ending finally near the outlet opening 61 in an essentially cylindrical longitudinal section (not shown).

In principle, the form of the two contact surfaces 35 and 62 is of no consequence. Although FIGS. 1 to 4 show sealing and contact surfaces 35 and 62 as flat surfaces, it would be possible to do without a flat configuration of the contact surfaces 35 and 62, as appears in particular in FIG. 4 in connection with a projection 8 extending into a recess 36 provided in the opener roller housing 30. It is merely necessary for the two contact surfaces 35 and 62 to be provided with matching forms. For example, the outer walls 84 of the projection 8 and the inner walls 37 of the recess 36 can be made in form of interacting contact surfaces forming the .s2, whereby one of these two contact surfaces can also be provided with a seal. These contact surfaces can of course also be given different forms if desired, even without providing a projection 8 of the fiber feeding channel 6 extending into the wall of the opener roller housing 30.

Figure 5:
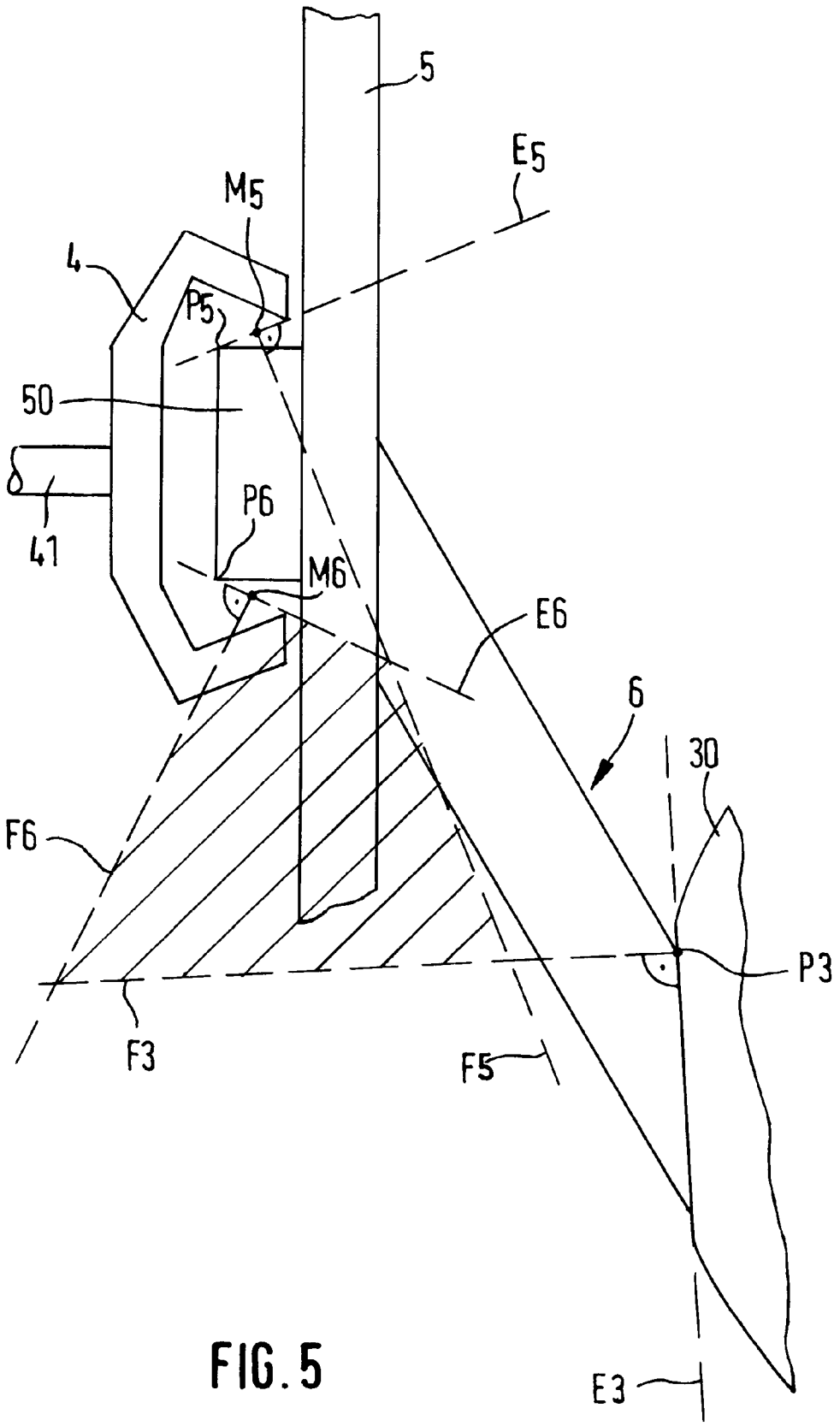
FIG. 5 shows an area for the placement of the swiveling axle.

FIG. 5 shows the sketch of the area in which the swivel pin 10 may be located. As described earlier, criteria must be met on the one hand so that the fiber feeding channel 6 can be removed at the contact surface $E_3$ and on the other hand it must be possible to move the lid extension 50 out of the opening of the spinning rotor 4. The admissible area in which the swivel pin 10 may be located is advantageously determined by the three surfaces $F_3$, $F_5$ and $F_6$. The surface $F_3$ stands perpendicularly on the contact surface $E_3$ and on a point $P_3$ of the rotor lid 5. The point $P_3$ is determined in that it comes closest to the opener roller or to its opener roller housing 30 when the rotor lid 5 is swiveled. The surface $F_5$ stands perpendicularly on the center of the connecting plane $E_6$ and on a point $P_5$ of the lid extension 50. The point $P_5$ is determined in that it comes closest to the opening of the spinning rotor 4 during swiveling. The surface $F_6$ stands vertically on the center point $M_6$ of the connecting surface $E_6$ and on a point $P_6$ of the lid extension 50. The point $P_6$ is determined in that it is closest to the opening of the spinning rotor 4 during swiveling as well as to the swivel pin 10 of the rotor lid 5. $M_5$ and $M_6$ refer respectively to the center of the line between the critical points $P_5$ or $P_6$ of the lid extension 50 and the rotor edge, i.e. the opening of rotor 4.

The area shown in which the swivel pin 10 may be located concerns the case of a one-piece fiber feeding channel 6 or the case where the rotor lid 5 and the fiber feeding channel 6 are to be swiveled away together with the lid extension 50 from the spinning rotor 4 and the opener roller housing 30. In the case of a split fiber feeding channel 6 which is also covered by the invention, the possible area to be considered for the swivel pin 10 is greater.

It will be apparent to those skilled in the art that various modifications and variations can be made in the present invention without departing from the scope and spirit of the invention. It is intended that the present invention include such modifications and variations as come within the scope of the appended claims and their equivalents.

We claim:

1. An open end spinning device, comprising:

an opener roller disposed in an opener roller housing, said opener roller housing having an outlet for fibers opened by said opener roller generally surrounded by a second contact surface;

a spinning rotor having an open side and a collection surface for receiving fibers from said opener roller and spinning the fibers into a continuously withdrawn yarn;

a pivotable rotor lid mounted on a swivel pin, said rotor lid further comprising a lid extension that extends through said open side of said spinning rotor and into said spinning rotor towards said collection surface in a swivelled closed position of said rotor lid, said rotor lid further comprising a fiber feeding channel having an inlet opening generally surrounded by a first contact surface and an outlet in said lid extension to direct fibers from said opener roller to said fiber collection surface; and wherein said first contact surface of said fiber feeding channel contacts against said second contact surface of said opener roller housing in said swivelled closed position of said rotor lid, said contact surfaces being in a plane essentially tangential to an outer circumferential surface of said opener roller and inclined towards or parallel to said open side of said spinning rotor so that said rotor lid is movable to a swivelled open position wherein as said lid extension is swung out of said spinning rotor, said first contact surface moves out of contact and away from said second contact surface.

2. The open end spinning device as in claim 1, wherein said swivel pin is disposed in an area circumscribed by a line perpendicular to a plane through said second contact surface at a point where said rotor lid comes closest to said opener roller housing during swivelling thereof, and a line perpendicular to a centerpoint of a connecting line from an uppermost end of said lid extension to an adjacent wall of said spinning rotor defining said open end, and a line perpendicular to a centerpoint of a connecting line for a lowermost end of said lid extension to an adjacent wall of said spinning rotor defining said open end.

3. The open end spinning device as in claim 1, wherein said swivel pin is at a greater distance from a center point of said lid extension than form said first contact surface.

4. The open end spinning device as in claim 1, wherein said rotor lid is mounted on said swivel pin with a fork-like drag bearing.

5. The open end spinning device as in claim 1, wherein said swivel pin comprises a longitudinal section on which said rotor lid is swivelled between said closed and open positions, and a separate longitudinal section having a flattened profile for removing or movating said rotor lid on said swivel pin.

6. The open-end spinning device as in claim 5, wherein said flattened profile extends along a centerline of said fork-like bearing when said rotor lid is swivelled to said open position.

7. The open-end spinning device as in claim 1, further comprising a stop disposed to contact and secure said rotor lid in said closed position.

8. The open-end spinning device as in claim 1, wherein said rotor lid extends in a plane that is perpendicular to a rotational axis of said spinning rotor, said swivel pin disposed in said same plane perpendicular to said rotational axis of said spinning rotor.

9. The open-end spinning device as in claim 1, wherein said rotor lid is replaceable to adapt to different diameter spinning rotors with said fiber feeding channel remaining essentially straight from said contact surfaces to said spinning rotor for said different size diameter spinning rotors.

10. The open-end spinning device as in claim 1, further comprising a seal device between said first and second contact surfaces.

11. The open-end spinning device as in claim 10, further comprising a flange member disposed around said inlet opening of said fiber feeding channel, said seal disposed in said flange member.

12. The open-end spinning device as in claim 1, wherein said fiber feeding channel further comprises a projection having said inlet defined therein which extends into a recess of said opener roller housing, said projection having an end towards said opener roller with a contour adapted to that of an inner circumferential wall of said opener roller housing.

13. The open-end spinning device as in claim 12, wherein when viewed in a rotational direction of said opener roller, said recess has a first wall recessed from said opener roller housing inner circumferential wall and a second wall extending beyond said opener roller housing inner circumferential housing towards said opener roller.

14. The open-end spinning device as in claim 13, wherein said second wall comprises a convex surface merging into said end of said fiber feeding channel projection.

* * * * *